US005232636A

United States Patent [19]

Cates et al.

[11] Patent Number: 5,232,636

[45] Date of Patent: Aug. 3, 1993

[54] COOLING TOWER STRAINER TANK AND SCREEN

[75] Inventors: Robert E. Cates, Arnold; William H. Smith, Baltimore; Edward N. Schinner, Highland; Katherine K. Flamm, Baltimore; Vladimir Kaplan, Silver Spring, all of Md.

[73] Assignee: Baltimore Aircoil Company, Inc., Jessup, Md.

[21] Appl. No.: 738,567

[22] Filed: Jul. 31, 1991

[51] Int. Cl.[5] ..... B01F 3/04

[52] U.S. Cl. ..... 261/4; 261/111; 261/DIG. 11; 55/228

[58] Field of Search ..... 261/4, 5, 111, DIG. 11; 55/228

[56] References Cited

U.S. PATENT DOCUMENTS

| | | | |
|---|---|---|---|
| 1,501,416 | 7/1924 | Lane | 55/228 |
| 2,545,926 | 3/1951 | Lau Bach | 62/139 |
| 2,732,190 | 1/1956 | Mart | 261/21 |
| 2,775,310 | 12/1956 | Shelton | 261/111 |
| 2,854,090 | 9/1958 | Slough | 261/111 |
| 3,298,672 | 1/1967 | Fordyce | 261/4 |
| 3,465,504 | 9/1969 | Oropeza et al. | 55/228 |
| 3,700,110 | 10/1972 | Engalitcheff | 210/308 |
| 3,856,487 | 12/1974 | Perez | 55/228 |
| 3,964,886 | 6/1976 | Engalitcheff, Jr. et al. | 55/228 |
| 4,530,804 | 7/1985 | Cates et al. | 261/30 |
| 4,592,878 | 6/1986 | Scrivnor | 261/111 |
| 4,683,101 | 7/1987 | Cates | 261/146 |

FOREIGN PATENT DOCUMENTS

| | | | |
|---|---|---|---|
| 212012 | 3/1924 | United Kingdom | 261/111 |
| 718487 | 11/1954 | United Kingdom | 64/1 |

OTHER PUBLICATIONS

Pamphlet-"Havens Cooling Towers" M Series Doubictions, Havens Steel Co., Kansas City, Mo. 64146.

Brochure-"Series 3000 Industrial Cooling Towers", Baltimore Aircoil Co., Bulletin S241/1-OH.

Cameron Hydraulc Data, edited by G. V. Shaw and A. W. Loomis, pp. 7-13, Cpr 1968, Ingersoll-Rand.

*Primary Examiner*—Tim Miles

*Attorney, Agent, or Firm*—Edward J. Brosius; F. S. Gregorczyk; Thomas J. Schab

[57] ABSTRACT

A cooling system with at least one cooling tower and multiple upper pans or distribution manifold pipes is provided with a strainer tank assembly at the tower lower end in proximity to the sump to receive incoming fluid for cooling, which strainer tank includes a screen to strain particulate material from the inlet fluid communicated to the tower upper end and to equally distribute this fluid at the lowest elevation at a pressure with a higher static pressure component than its dynamic pressure component to avoid a requirement for a flow control valve to provide relatively quiescent fluid for fluid distribution to the tower and fluid transfer media therein. A pressure relief baffle in the strainer tank is operable in response to a fluid overpressure condition to bypass the screen and open fluid communication to avert catastrophic failures within the fluid circuit.

11 Claims, 4 Drawing Sheets

COOLING TOWER STRAINER TANK AND SCREEN

BACKGROUND OF THE INVENTION

Cross-flow cooling tower apparatus with single or multiple air entry passages, and chambers for heat/mass transfer media, which are frequently cooling towers with fluid transfer medium having gravity-fed fluid flowing through to be cooled by transversely flowing air. These present apparatus have fluid systems and circuits including pumps to provide fluid at a pressure at the upper end of the cooling towers. The fluids at a pressure have both a static and dynamic component with the static pressure being relatively small for a conduit connection directly extending from the pump to the upper end of the tower for deposition of warm fluid in a fluid basin at an elevated dynamic pressure. Transfer of fluids with a large dynamic component is associated with high turbulence, and these fluids are more difficult to control during fluid distribution to the basin pans and the fluid transfer media. Erratic fluid flow to the fluid transfer media results in erratic flow through the fluid transfer media and concomitantly inefficient fluid cooling. A discussion of the differences between static pressure and the dynamic or velocity head (pressure) is provided in *Cameron Hydraulic Data*, edited by G. V. Shaw and A. W. Loomis, Twelfth Edition, Third Printing, Ingersoll-Rand Company, New York, New York (pp. 9–13).

In an attempt to control the fluid turbulence and to more smoothly deliver fluid at an elevated temperature for cooling in the transfer media, flow control valves are provided in the fluid circuit to receive the warmed fluid at a dynamic pressure, abate the turbulence and provide smooth, even distribution of the warmed fluid to the basin pan or pans for transfer to the fluid-cooling media. A flow control valve is illustrated in U.S. Pat. No. 4,592,878 to Scrivnor which incorporates a rotary flow control valve and a predistribution pan in cooperation with a distribution pan. This valve is positioned above the transfer media of a tower to receive the warm fluid flow. However, as with most tower assemblies the location of operating assemblies in remote or relatively inaccessible regions requires framing, ladders, catwalks and other associated structural members for viewing, repair or replacement. The flow-control valve and structural assemblies are all added cost factors, which components are a result of the distribution problem associated with the relatively large dynamic component of fluid pressure at the upper end of the tower and the associated turbulence and irregular fluid distribution. The requirement for a flow-control valve is especially evident when it is necessary to balance the flow to two (2) or more distribution basin pans.

Cross-flow cooling towers, as illustrated in the above-noted U.S. Pat. No. 4,592,878 to Scrivnor and more particularly in U.S. Pat. No. 2,732,190 to L. T. Mart, are utilized to reduce the temperature of a fluid (water) by a current of air horizontally traversing a cooling tower media having the fluid coursing vertically downward. Fluid is communicated to the basin above the towers from a supply source, for downward flow through the fluid cooling media, which may be horizontal slats, molded panels, or other media. The cross-flowing air and any air-entrained fluid flows through a drift eliminator section, which captures most of the entrained water particles, prior to air discharge from the tower. The warm fluid received from a piping network may carry spalled sidewall rust or other particulate material in the fluid stream. The entrained particulate material can lead to clogging of apertures in the basin, which would require maintenance at the tower upper end at the basin pan to dislodge and remove the entrapped materials, and to clear the orifices for unimpeded fluid transfer, As a consequence of all of the above it is desirable to remove entrained particulate matter from fluids transferred to the cooling towers before fluid transfer to the basin pan or pans. Further, obviating the need for a flow-control valve would reduce the assembly size, avoid maintenance of the valve above the tower and remove the necessity for ladders, catwalks and support structures for accessing the additional equipment. A flow-control valve is generally required above each basin pan of a cross-flow cooling tower system, and in the position above the towers these valves are relatively difficult to service and maintain. Therefore, any provision to eliminate or alleviate these valves would avoid not only the original equipment cost, but also avoids the maintenance and service costs, as well as lost cooling capacity time during periods of poor fluid distribution.

SUMMARY OF THE INVENTION

The present invention provides a fluid inlet strainer tank for fluids communicated to either counterflow or crossflow-type cooling towers. The strainer tank is operable to receive incoming warm fluid at the tower lower end for transfer through a screen to the cooling tower or towers. The fluid is pumped to the upper end of the tower for gravity feed through a fluid-transfer media, but it is at a total pressure with a relatively small dynamic and turbulent component and a relatively large static and quiescent component, which provides inherently-balanced fluid control without a control valve at the basin pan. Further, the screen in the strainer tank captures and separates any larger sized, not microscopic or dust-sized particles, entrained materials in the incoming fluid. The entrained materials may be from piping degradation, large rust particles and spalls. A drain plug or cleanout is provided for periodic maintenance and cleaning of the strainer tank and screen without dismantling or removing the strainer tank.

In a further embodiment, the strainer tank screen is provided with a relief-valve-like arrangement to alleviate any potential over-pressure or blookage conditions in the strainer tank and avoid undue mechanical damage to the strainer tank, the screen, the upstream piping or the cooling tower assembly.

BRIEF DESCRIPTION OF THE DRAWING

In the figures of the drawing like reference numerals identify like components and in the drawing.

DETAILED DESCRIPTION OF THE PREFERRED EMBODIMENT

Figure 1:
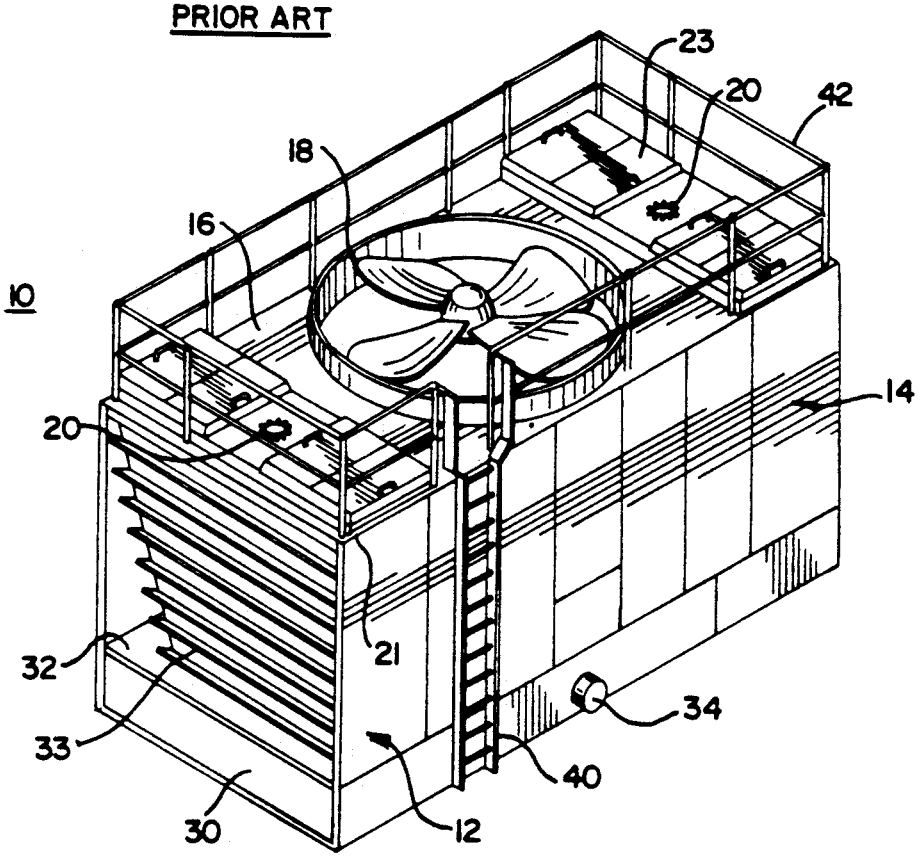
FIG. 1 PRIOR ART
FIG. 1 is a schematic illustration of a prior art, cross-flow, dual upper-basin pan cooling tower structure.

Cross-flow cooling tower assemblies 10 in FIG. 1 have been known and used to cool warm water or to heat air for various heat exchange and cooling operations, but they are most commonly utilized to reject waste-heat to the atmosphere. In FIG. 1, assembly 10 has first cooling tower-half 12 and second cooling tower-half 14, however, as tower-halves 12 and 14 are structurally and operably similar only first tower-half 12 will be described, but the description is equally applicable to tower-half 14 or any other multiple-flow tower arrangement as well as the illustrated dual-flow tower 10. Assembly 10 includes a fan deck and cowl 16 with fan 18, to promote air flow through the plenum and fluid transfer media in tower-halves 12 and 14.

Figure 2:
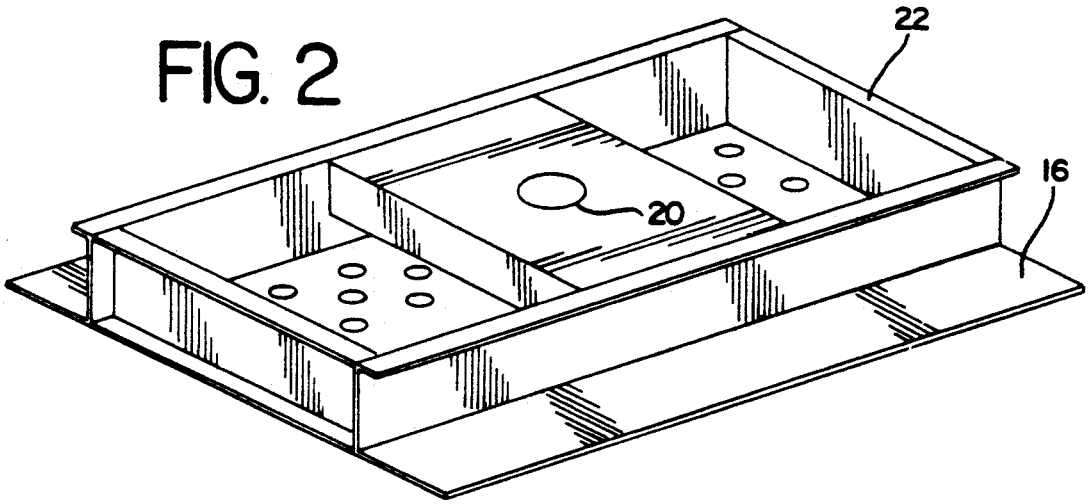
FIG. 2 is an enlarged view of a hot water basin for a cooling tower.
Figure 3:
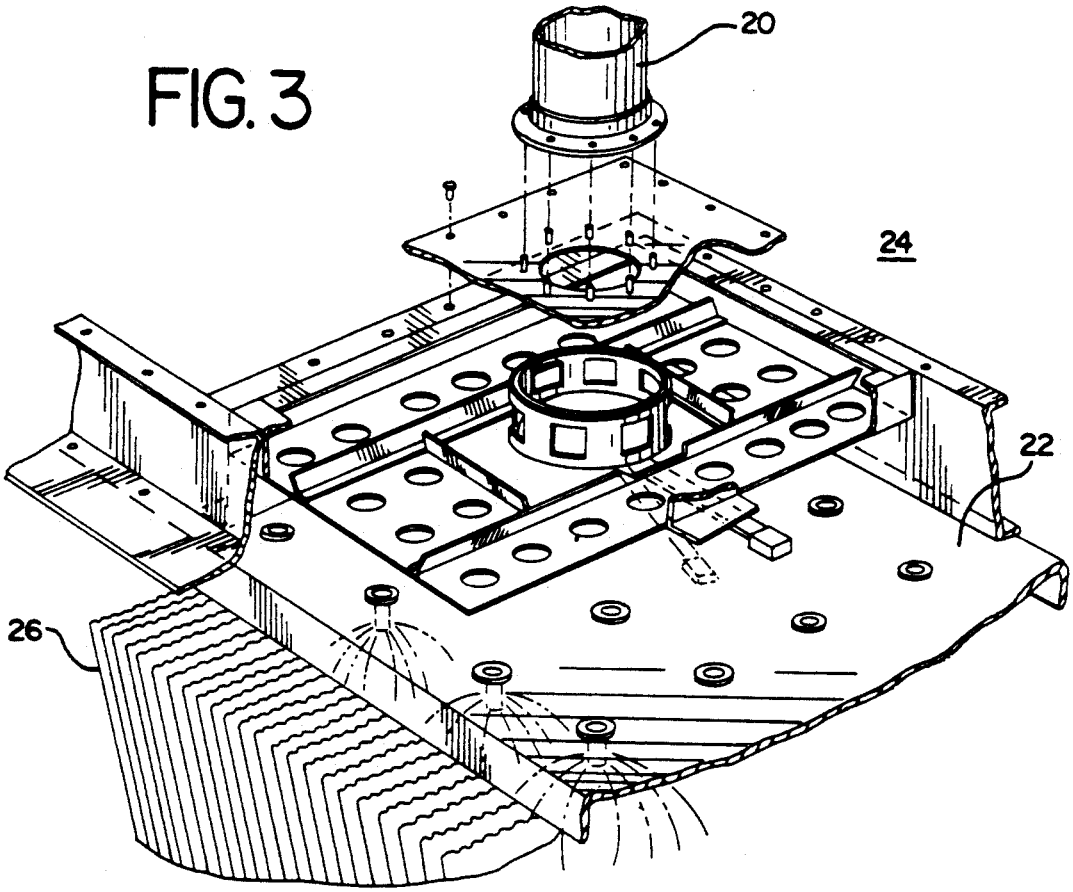
FIG. 3 is a flow control valve for coolant to a tower basin.

In these prior art structures in FIG. 1, warm coolant fluid, which is generally water, at a temperature higher than ambient air temperature is introduced at hot water inlets 20. Inlets 20 are situated above basin pan 22 at tower upper end 21 in FIG. 2, and may have for example a control valve assembly 24 as shown in FIG. 3 and as taught in U.S. Pat. No. 4,592,878. In this illustration, the warm water is provided to warm water inlet 20 and valve 24 at tower upper surface 21 for delivery to and distribution by basin pan 22 to fluid transfer media 26 of FIGS. 3 and 5. Fluid transfer media 26 may be slatted boards, corrugated panels or other media known in the art to transfer fluid vertically while allowing horizontal air flow for cooling, or alternatively it allows upwardly vertical airflow in counterflow towers. Sump 30 at tower lower surface 32 receives and stores cooled fluid from tower-half 12 and has discharge port 34 for transfer of fluid to air or heat exchange devices through a network of pumps and conduits (not shown) for recirculation through a coolant system. In the prior art arrangement of FIG. 1, individual tower-halves 12, 14 required individual hot fluid inlets 20 and fluid control valves 24 to minimize the turbulence from the dynamic pressure component of the total fluid pressure at inlet 20 and to more evenly distribute this warm fluid to basin pan 22 for more uniform communication to transfer media 26. As shown in FIG. 1, assembly 10 requires extensive framework beyond the tower framing, which framework includes ladders 40, railings 42 and catwalks on the upper side 21 for maintenance, repair and replacement operations.

Figure 4:
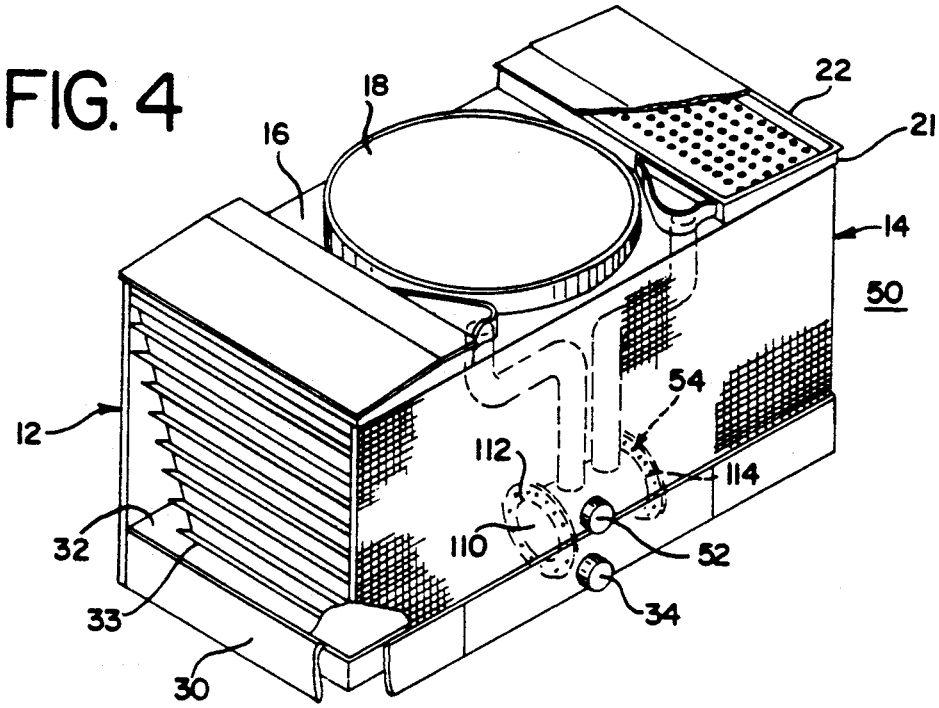
FIG. 4 is a schematic view in perspective of the strainer tank in a cross-flow cooling tower.
Figure 5:
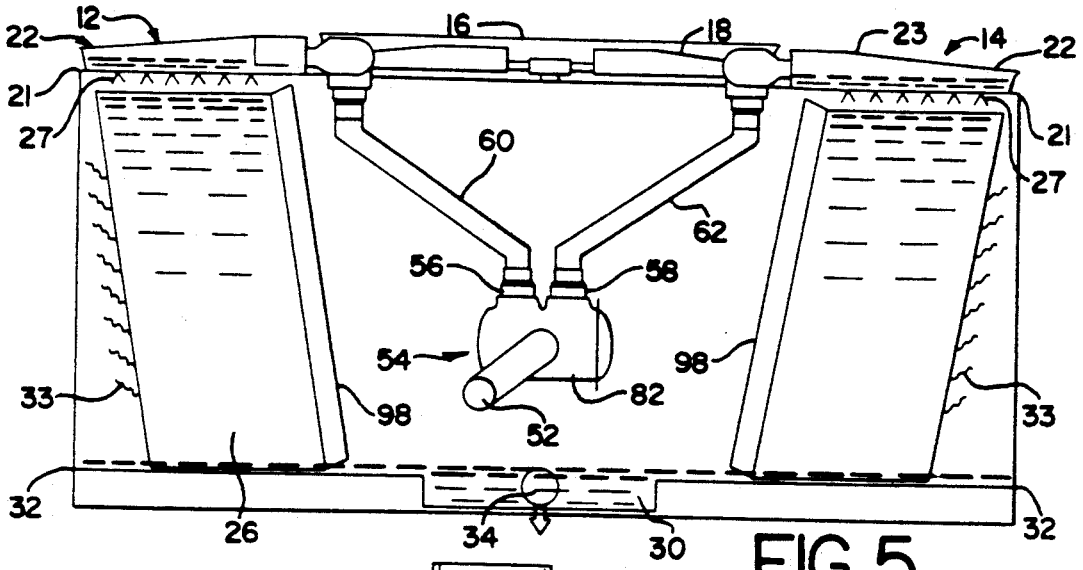
FIG. 5 is a detailed cross-sectional elevational view of the tower assembly in FIG. 4.

In FIGS. 4 and 5, a cross-flow cooling tower assembly 50 has first and second tower-halves 12 and 14 having hot-fluid basin pan 22 at tower upper end 21 with discharge port 34 and sump 30 at tower lower end 32. Fluid transfer media 26 includes louvers 33 and mist eliminators 98, however, no ladders 40, railings 42 or other extraneous superstructure elements are required. In this embodiment, warm fluid from the conduit, pump and heat exchange or cooling apparatus (not shown) is communicated to single warm water inlet 52 at lower end 32 and above sump 30.

In FIG. 5, hot fluid inlet 52 is coupled to strainer tank 54 generally mounted in the plenum of assembly 50 at tower lower end 32, which strainer tank 54 has a first outlet 56 and second outlet 58 with conduits 60 and 62 extending to basin pans 22 at upper surfaces 21 of tower-halves 12 and 14, respectively. Warm fluid is thus directly communicated to basin pans 22 of tower assembly 50 with no fluid control valve 24 in the fluid circuit. In FIG. 5, apertures or nozzles 27 direct warm fluid from basin pan 22 to fluid transfer media 26 in the tower-halves 12 and 14. Basin pans 22 in tower 50 include covers 23 to generally enclose pans 22, which avoids air-blown particle contamination to the fluid and evaporation of fluid from pans 22.

Strainer tank 54 is a multi-function apparatus operable to receive the warm fluid for cooling, which tank 54 serves as a small reservoir and distribution manifold. Strainer tank 54 distributes fluid to first and second tower-halves 12 and 14 in a manifold-like manner, as well as straining the warm fluid through screen 70, which is noted in cross-section in FIG. 6.

Figure 6:
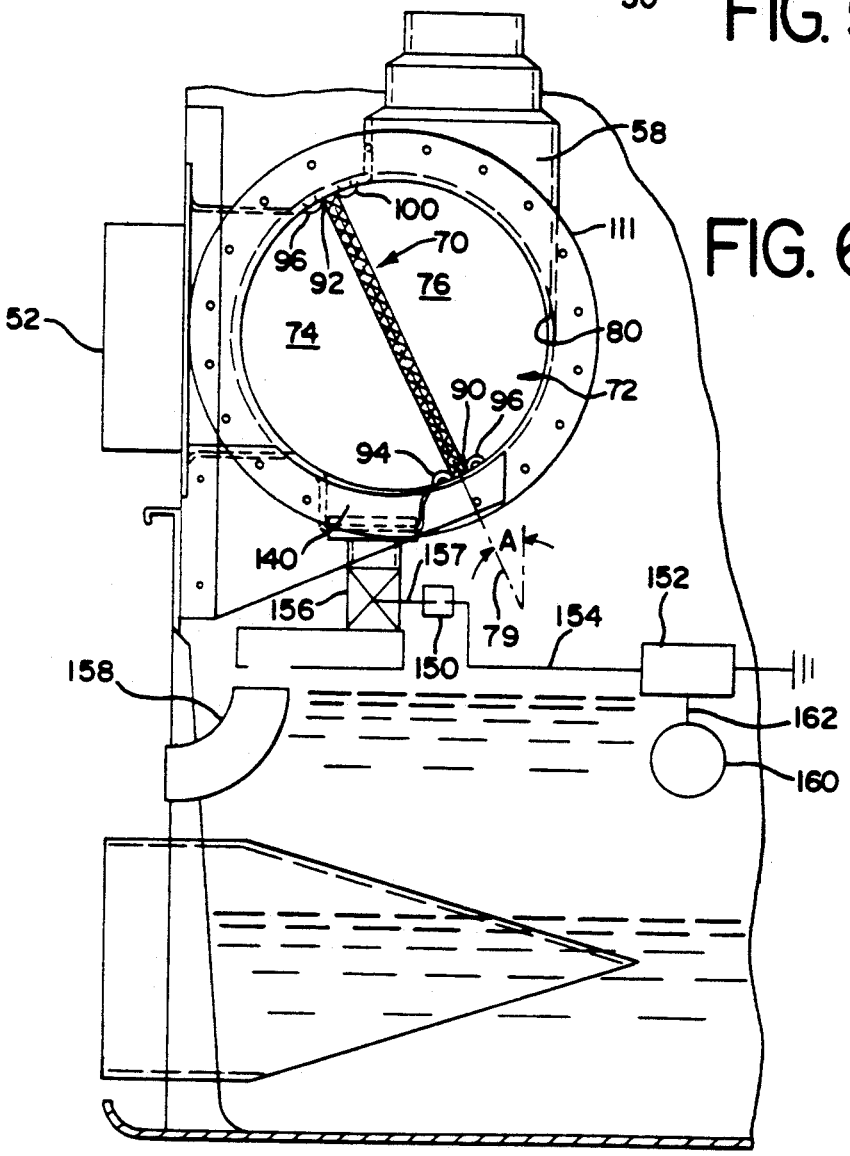
FIG. 6 is an open end view of the strainer tank of FIG. 4.

In FIG. 6, strainer tank 54 is shown as a circular section through a cylindrical structure. Tank 54 has chamber 72 generally extending along longitudinal axis 78 (cf. FIG. 5) and bounded by inner wall 80, which chamber 72 has front or receiving portion 74, strainer screen 70 and back or discharge portion 76. Inlet port 52 extends through strainer tank wall 82 to communicate warm fluid to chamber 72, and specifically to receiving portion 74. Screen 70 is mounted in chamber 72 generally parallel to axis 78, and separates chamber portions 74 and 76.

In the illustration of FIG. 6, valve 156 is connected to drain trap 140 and is movable to provide fluid, and thus particulate, communication from trap 140 and input section 74 to pipe and dirt outlet 158. A solenoid operator 150 is coupled to sensor 152 by line 154 and is connected to valve 156 by arm 157. Sensor 152 is operable to provide a signal to energize solenoid 150 and open valve 156. Pump 160 in this illustration provides fluid to inlet 52 at a pressure for transfer through strainer tank 54 to conduits 60 and 62 and tower upper end 30. Sensor 152 is coupled to pump 160 by line 162 to sense a signal indicative of pump disengagement. In the preferred embodiment, disengagement of pump 160 provides an activation signal to sensor 152 to energize solenoid 150 and open valve 156 for flushing particulate matter from trap 140 to outlet 158. Further, the static fluid pressure head in conduits 60 and 62 acts to backflush the particulate matter on screen 70 and to flush it into outlet 158 at the opening of trap 140. The period or frequency of the draining and flushing may vary and is a design choice, which may be provided by a timer, by manual operation or other means known in the art.

Figure 7:
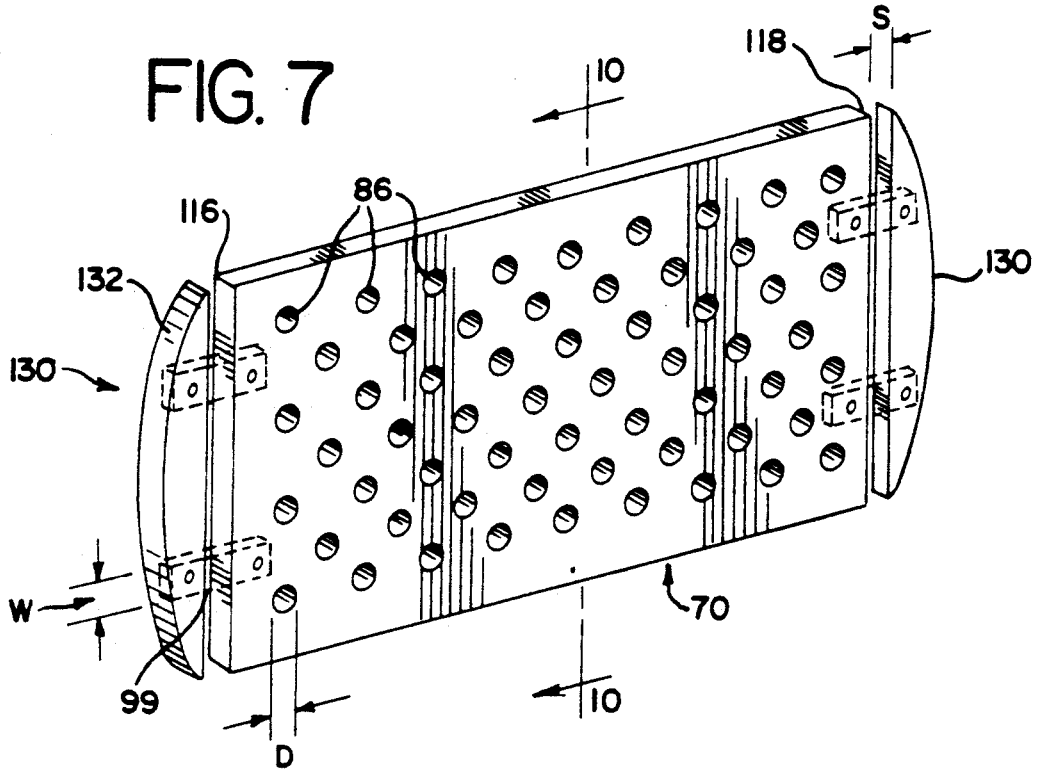
FIG. 7 is a perspective view of the strainer tank screen and pressure relief baffles.
Figure 10:
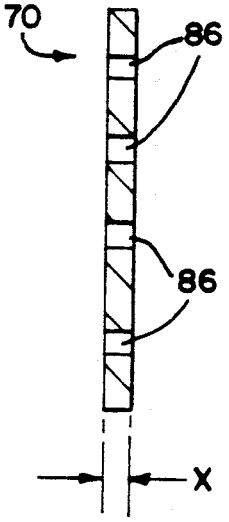
FIG. 10 is a cross-sectional view taken along the line 10—10 in FIG. 7 of the filter screen.

Screen 70 in FIG. 7 is shown as a rectangular segment with a plurality of apertures 86 and a narrow wall thickness "x" as noted in FIG. 10. Screen 70 is mounted in chamber 72 in lower slot 90 between detents 94 and 96 and upper slot 92 between detents 98 and 100, which detents 94–100 are mounted on sidewall 80. As noted in FIG. 6, screen 70 with transverse axis 79 is angularly rotated, such as angle 'A' from the vertical in chamber 72 to separate front and rear portions 74 and 76, respectively. In this position, inlet fluid and any entrained particulates introduced at inlet port 52 must pass through chamber portions 74 and 76 to outlet ports 56 and 58 and conduits 60, 62, respectively, as shown in FIG. 5. Warm water or cooling fluid passing through a fluid circuit or network of pipes, valves and pumps may encounter and entrain large particulate matter such as rust, blisters or spalls from the piping walls. This entrained matter has the potential to block or inhibit flow in the cooling tower-halves 12, 14, apertures or nozzles 27, basin pans 22 or the connecting ductwork. Therefore, it is prudent to capture and remove this entrained material from the fluid ahead of the cooling tower-halves 12, 14 and pan basins 22. In FIG. 4, strainer tank 54 has flush end plates 110 covering each of strainer-tank ends 112 and 114, which end plates 110 are operable to be in proximity to first and second ends 116, 118 (cf. FIG. 7) of screen 70 to inhibit fluid flow between screen ends 116, 118 and the inner wall surface of covering end plates 110. Alternative arrangements include direct securement of end plates 110 to screen 70, and other assembly configurations are also available for screen 70 and end plates 110.

Figure 8:
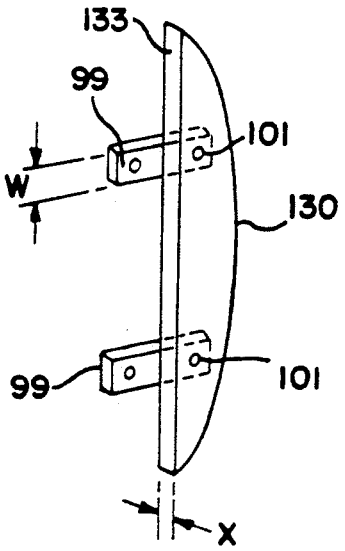
FIG. 8 is a perspective view of the strainer-tank, screen-end baffle and break away plate of FIG. 7.
Figure 9:
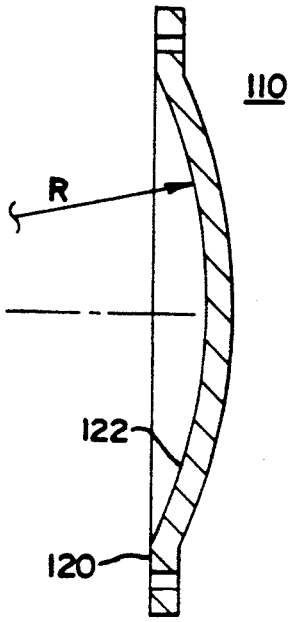
FIG. 9 is a cross-section of an end plate cover for the strainer tank.

In an alternative embodiment, strainer tank 54 and screen 70 may further include a pressure relief system as noted in FIG. 7. In the illustration of FIG. 9, tank end closure plates 110 have an arced inner surface 122 with a radius of curvature, 'R,' in inner wall surface 120. Although the end plates are preferably arced for the most efficient stress distribution, it is recognized that the end plates and baffles may be rectangular in a rectangular tank, as well as other shapes. Baffles 130 with arced face 132 and chordal face 133, which are approximately the thickness 'x' of screen 70, are coupled to screen ends 116, 118 by breakaway plates 99 of a fixed length 'w.' Breakaway plates 99, which may be fiberglass reinforced polyester (FRP), an acrylic or other brittle plastic, are secured to baffles 130 and screen 70 by bolts 101 in the illustration of FIGS. 7 and 8. Baffles 130 are separated from screen ends 116, 118 by a distance 's,' which is less than or equal to the dimension or diameter 'd' of apertures 86, to inhibit extraneous fluid flow and entrained particulate flow therethrough during normal operation and fluid flow. Baffle 130 has a half-moon appearance in an elevational view with an outward radius of curvature of approximately 'R' for mating with end plate arced surface 122. At an elevated fluid pressure in chamber 72, such as from an excess of entrained material on screen 70 in inlet portion 74, baffles 130 may bend, deflect or fracture at neck or plates 99 to allow fluid flow past the screen end 116 or 118 to open fluid communication between inlet portion 74 and discharge portion 76 in strainer tank 54. Thus the elevated fluid pressure would be relieved and a hazardous rupture of strainer tank 54 or other untoward damage to the system 10 or any upstream components would be averted. Rupture or opening of any of baffles 130 will relieve pressure build up in chamber 72, however, the repair of the ruptured baffle 130 is accommodated by removal of the end plates 110 and subsequent, replacement of screen 70 with baffles 130 and breakaway plates 99 to again mate with end plate arc-surfaces 122.

Although pressure relief baffles 130 are available to prevent undue fluid pressure in strainer tank 54, drain outlet 140 in FIG. 7 is available to clear screen 70 by a simple back flushing technique to remove entrapped particles for discharge through a duct outlet 142 coupled to drain and dirt trap 140. The regularly scheduled maintenance and cleansing of inlet portion 74 and screen 70 is thus accommodated without dismantling strainer tank 54.

In operation, strainer tank 54, receives warm fluid to be cooled in tower assembly 50 at inlet port 52. The fluid is received in inlet portion 74 of chamber 72 for transfer and filtering through filter screen 70 to chamber discharge portion 76. The fluid pressure from the pump in the fluid circuit develops a total fluid pressure to move the warm fluid to the tower upper end 21 and pan basin 22 through fluid conduits 60, 62 and outlet ports 56, 58, which are open to chamber discharge portion 76. The height differential between strainer tank 54 at tower lower end 32 and tower upper end 21 provides a large static pressure component to the total fluid pressure and distribution to lines 60 and 62 is inherently equalized as they have identical restrictions and the total pressure at inlet ports 60 and 62 are the same. Therefore, turbulence and erratic fluid distribution in pan basin 22 is negligible, which avoids the requirement for a flow control valve, such as valve 24, to control the fluid distribution to pan basin 22 and nozzles 27. The relatively smooth fluid flow in pan basin 22, provided by strainer tank 54 and the related large static pressure head component versus the small dynamic pressure head averts the requirement for a flow control valve 24 to control fluid distribution in pan basin 22 for smooth fluid flow to nozzles 27 and fluid transfer media 26. Thus the efficiency of the fluid transfer media 26 with regard to cooling of the warm fluid is maintained without the initial capital outlay for control valves as well as the avoidance of maintenance of such actual valve in an awkward and remote location atop a tower-half 12, 14. Further, the requirement for added superstructure components such as ladders, catwalks and railings are likewise avoided by displacing the operating and control equipment that is strainer tank 54, to the tower lower end 32 where it is easily accessible and maintainable.

Screen 70 is utilized to capture entrained materials above the screen hole size 'd.' These entrained materials include rusty particles or spalls from steel conduit sidewalls. Their capture in strainer tank 54 avoids the potential for accumulating these materials in pan basin 22 and/or nozzles 27, which might impede fluid flow or disrupt even fluid distribution in either pan basin 22 or fluid transfer media 26. The entrapped particulate matter in chamber inlet portion 74 is removable either manually or by back flushing and discharge through drain outlet 140 noted in FIG. 6 at a vertically lower position of strainer tank wall 82.

In the alternative embodiment utilizing the pressure-relief or baffle arrangement, baffle 130 is deflectable at an elevated pressure to rotate about breakaway plate or plates 99 in response to an elevated pressure in either inlet portion 74. The radius of curvature of both end plate inner wall surface 122 and baffle 130 being about equal to 'R,' the two curved surfaces conform to each other to provide a barrier to fluid flow under normal operating conditions. However, breakaway plates 99, which separate chordal face 133 from screen ends 116, 118 by a distance 's' equal to or less than the dimension of screen aperture 86, are designed with a thickness and width 'w' to fracture or yield at a predetermined pressure. Baffle 130 is thus rotatable about breakaway plates 99 to allow flow past screen ends 116, 118 to relieve the pressure. Pressure relief in chamber 72 avoids catastrophic failure of any components in the fluid circuit including fracture of strainer tank 54, which may be a material such as high density polyethylene, polyvinylchloride or a combination of these or other thermoplastics or thermosetting polymers. Repair of screen 70 after an overpressure condition is easily accommodated by removal of end-closure plate 110, which is generally bolted to flange 111 (cf. FIG. 6). Thus replacement of screen 70 with baffles 130 as well as subsequent remounting of end-closure plate 110, is easily accommodated without repair in a precarious perch or position. The aversion of catastrophic failures avoids costly replacement of large subassembly portions of the cooling system. Further, almost all of the regular maintenance, that is clearing screen 70 and strainer tank 54, is accommodated at tower lower end 32; does not require maintenance activity in remote or elevated locations to enhance operation safety; and, reduces product operating cost and maintenance.

The arrangement of screen 70 in strainer tank 54 allows automatic back-flushing of screen 70 to dislodge accumulated material. At pump shutdown, falling coolant fluid pressure reverses flow in pipes 60 and 62, which forces particulate matter on screen 70 to fall by gravity to discharge port 140 and its associated dirt trap. Apparatus, as known in the art, permits time-delayed valve opening to automatically flush dirt trap 140 at each pump shut-off, whether daily, hourly or other time-controlled period, which avoids particulate build up in dirt trap 140. Coolant fluid concurrently removed with particulate matter can be taken from the requisite cooling tower bleed budget to avoid wasting coolant fluid.

While only specific embodiments of the invention have been described and shown, it is apparent that various alternatives and modifications can be made thereto. Those skilled in the art will recognize that certain variations and alternatives can be made in these embodiments. It is, therefore, the intention in the claims to cover all such modifications and alternatives as may fall within the true scope of the invention.

We claim:

1. A crossflow cooling system for reducing the temperature of a fluid at a first temperature to a lower second temperature, said system comprising a tower framework with a fluid sump, at least one air entry passage, at least one chamber for heat and mass transfer media, each said chamber having at least one fluid transfer element, an upper end, a lower end, at least one of a fluid basin and a manifold at said upper end, a strainer tank above said basin having means for screening and means for conducting said fluid coupled between said strainer tank and said fluid basin, said strainer tank positioned at said framework lower end and operable to receive said fluid at a first temperature, to screen said fluid and to communicate equal volumes of said fluid to each said conducting means and said upper end at a strainer tank fluid pressure having a static pressure component larger than its dynamic pressure component to provide an evenly distributed fluid at said tower framework upper end.

2. In a crossflow cooling system for reducing the temperature of a fluid at a first temperature to a lower second temperature, said system having a tower framework with a fluid sump, at least one air-entry passage, at least one chamber for heat and mass-transfer media, each said chamber having means for transferring fluid, an upper end, a lower end, a fluid basin at said upper end, and a discharge port at said fluid sump, the improvement comprising:

an inlet port to receive said fluid at a first temperature generally positioned at said lower end;

a strainer tank having a housing with a longitudinal axis and defining an enclosure, an input port and at least one output port, said inlet port coupled to said strainer tank input port to communicate said fluid at a first temperature to said enclosure;

conduit means connected between said strainer-tank output port and said fluid basin to communicate fluid at a first temperature from said enclosure to said fluid basin;

a strainer screen with a plurality of apertures positioned in said enclosure generally parallel to said longitudinal axis between said input port and output port to strain entrained particulates above a predetermined size from said fluid in said strainer tank, which is operable at said tower lower end to provide a large static component relative to the total fluid pressure at the tower lower end, to equalize fluid flow to all outlet ports, to minimize the dynamic component of the total pressure and to reduce the turbulence associated with said dynamic component at said enclosure independently of a balancing valve.

3. In a cooling system as claimed in claim 2 wherein said housing is high density polyethylene.

4. In a cooling system as claimed in claim 2, said system further comprising a first air-entry passage with a chamber for heat and mass transfer media, and a second air-entry passage with a chamber for heat and mass transfer media, a first upper fluid basin and a second upper fluid basin for each said first and second chambers, respectively, said strainer tank having a first outlet port and a second output port, a first conduit and a second conduit connected between said first and second outlet ports and said first and second upper fluid basins, respectively, to communicate said fluid at a first temperature to said upper fluid basins from said strainer tank.

5. In a cooling system as claimed in claim 2, wherein said strainer-tank housing is a cylinder having said input port intersecting said enclosure approximately normal to said longitudinal axis.

6. In a cooling system as claimed in claim 5 wherein said strainer screen is generally parallel to said longitudinal axis and cooperating with said housing to define a fluid input section and a fluid output section within said enclosure.

7. In a cooling system as claimed in claim 6 wherein said housing has a sediment trap and drain at said housing input section, said trap and drain operable to open communication to said input section to discharge entrained particulates entrapped by said filter screen. communicate equal volumes of said fluid to each said conducting means and said upper end at a strainer tank fluid pressure having a static pressure component larger than its dynamic pressure component to provide an evenly distributed fluid at said tower framework upper end.

8. In a cooling system as claimed in claim 7, said system further comprising:

an overflow-dirt outlet;

means for connecting said trap and drain to said dirt outlet;

a valve connected to said drain and operable to open communication between said trap and input section to said dirt outlet to discharge said entrapped particulates.

9. In a cooling system as claimed in claim 8, said system further comprising a solenoid operator coupled to said valve and operable to move said valve and open communication between said trap and said dirt outlet.

10. In a cooling system as claimed in claim 9, said system further comprising a pump coupled to said inlet port and strainer tank to communicate said fluid at said fluid pressure to said tank;

means for sensing disengagement of said pump;

said solenoid connected to said valve;

a line connecting said sensing means and solenoid operator, said solenoid operator operable in response to said sensed signal to open said valve and drain for communication of said trap and input section to said dirt outlet for discharge of said particulates.

11. In a cooling system as claimed in claim 10 wherein said fluid in said conducting means conducting at said tower framework upper end provides a pressure head in said strainer tank at said pump disengagement;

said static pressure head operable to backflush said screen to purge said entrapped particulates at opening of said valve and trap.

* * * * *